US010612219B2

(12) United States Patent
Zhong

(10) Patent No.: US 10,612,219 B2
(45) Date of Patent: Apr. 7, 2020

(54) BATHTUB SPOUT QUICK CONNECTING MECHANISM

(71) Applicant: Tingting Du, Xiamen (CN)

(72) Inventor: Enzhou Zhong, Xiamen (CN)

(73) Assignee: Tingting Du, Xiamen, Fujian (CN)

( * ) Notice: Subject to any disclaimer, the term of this patent is extended or adjusted under 35 U.S.C. 154(b) by 225 days.

(21) Appl. No.: 15/415,893

(22) Filed: Jan. 26, 2017

(65) Prior Publication Data

US 2018/0127958 A1 May 10, 2018

(30) Foreign Application Priority Data

Nov. 7, 2016 (CN) ..... 2016 1 198762

(51) Int. Cl.

| | |
|---|---|
| ***E03C 1/04*** | (2006.01) |
| ***B05B 15/65*** | (2018.01) |
| ***B05B 1/18*** | (2006.01) |
| *B05B 1/30* | (2006.01) |

(52) U.S. Cl.

CPC ..... *E03C 1/0403* (2013.01); *B05B 1/18* (2013.01); *B05B 15/65* (2018.02); *B05B 1/3013* (2013.01); *E03C 1/0408* (2013.01)

(58) Field of Classification Search

CPC ..... E03C 1/023; E03C 1/025; E03C 1/0403; E03C 1/086; E03C 2201/00; E03C 1/0408; B05B 15/065; F16L 37/48; F16L 19/02; F16L 33/223; F16L 3/003

USPC ..... 4/678; 285/8

See application file for complete search history.

(56) References Cited

U.S. PATENT DOCUMENTS

| | | | | |
|---|---|---|---|---|
| 1,594,126 | A * | 7/1926 | Sigl | F04B 9/14 285/180 |
| 2,650,838 | A * | 9/1953 | Hirschland | F16L 37/48 285/180 |
| 5,743,570 | A * | 4/1998 | Garland | E03C 1/086 285/148.22 |
| 5,772,616 | A * | 6/1998 | Competiello | A61C 17/0214 285/8 |
| 2010/0314862 | A1* | 12/2010 | Hsia | E03C 1/08 285/8 |
| 2016/0010776 | A1* | 1/2016 | Medina | E03C 1/0403 285/8 |

(Continued)

FOREIGN PATENT DOCUMENTS

KR 20110009602 A * 1/2011

OTHER PUBLICATIONS

KR 20110009602 A Translation.*

*Primary Examiner* — Erin Deery
*Assistant Examiner* — William R Klotz
(74) *Attorney, Agent, or Firm* — Leong C. Lei

(57) ABSTRACT

A bathtub spout quick connecting mechanism includes a main body, a hand wheel, and a gasket. A boss of the hand wheel is inserted through an open top of the main body. A conical recess at an outer end of the boss is fitted on a pull rod head of a bathtub spout. The gasket is attached to the inner bottom surface of the main body. The gasket has a central perforation communicating with a through hole at the bottom of the main body. The conical recess of the hand wheel screwedly connected to the main body abuts against the pull rod head to drive the pull rod head to move up and down. The installation is convenient and quick.

3 Claims, 8 Drawing Sheets

(56) References Cited

U.S. PATENT DOCUMENTS

2016/0168830 A1* 6/2016 Medina ..... F16L 3/003
285/8

* cited by examiner

BATHTUB SPOUT QUICK CONNECTING MECHANISM

FIELD OF THE INVENTION

The present invention relates to a shower bath, and more particularly to a bathtub spout quick connecting mechanism.

BACKGROUND OF THE INVENTION

In the shower bath field, in particular the fixed shower head device, in order to make shower bath easy for pets, children or the disabled, it is necessary to directly connect a shower head with a bathtub spout. The existing products have the following problems: (1) For a plastic sleeve to be fitted on the bathtub spout firm, the plastic sleeve is made of a hard material, such as PVC. The elasticity of such a material is poor. Before installation, it needs to use hot water (70 degrees or more) to cook and soften the plastic sleeve. The installation is time-consuming and troublesome. (2) The plastic sleeve is easy to fall off and cause water leaking, due to the material of the plastic sleeve is hard and lack of good airtightness between the plastic sleeve and the bathtub spout. (3) The product is can only be applied to some of old-fashioned bathtub spouts without a pull rod, so its suitability is limited.

FIG. 1A is a schematic view showing the connection of a conventional shower head and a bathtub spout. The shortcomings are listed below.

(1) For a plastic sleeve 1' to be fitted on a bathtub spout 2' firm, the plastic sleeve 1' is made of a hard material, such as PVC. The elasticity of such a material is poor. Before installation, it needs to use hot water (70 degrees or more) to cook and soften the plastic sleeve. The installation is time-consuming and troublesome.

(2) Because the material of the plastic sleeve is hard, the airtightness between the plastic sleeve 1' and the bathtub spout 2' is insufficient. It is easy to cause water leaking and fall off.

(3) The product is only applied to some of old-fashioned bathtub spouts 2' without a pull rod ' so its suitability is limited.

Accordingly, the inventor of the present invention has devoted himself based on his many years of practical experiences to solve these problems.

SUMMARY OF THE INVENTION

The primary object of the present invention is to provide a bathtub spout quick connecting mechanism which can be installed conveniently and quickly and has a better suitability.

In order to achieve the aforesaid object, the bathtub spout quick connecting mechanism of the present invention comprises a main body, a hand wheel, and a gasket. The main body is a cylindrical member having an open top, a side wall opening, a through hole at a bottom thereof. An upper outer wall of the main body is formed with male threads. A top of the hand wheel is a disc. An outer edge of the disc extends downward to form an annular grip. An inner wall of the annular grip is formed with female threads. A bottom of the disc is provided with a boss extending in a direction perpendicular to the disc. A free end of the boss is formed with a conical recess therein. The female threads of the annular grip of the hand wheel screwing with the male threads on the upper outer wall of the main body. The boss of the hand wheel is inserted through the open top of the main body. The conical recess at the free end of the boss is fitted on a pull rod head of a bathtub spout. The gasket is attached to an inner bottom surface of the main body. The gasket has a central perforation communicating with the through hole at the bottom of the main body.

Preferably, an outer wall of the annular grip is formed with an arris.

Preferably, upper and lower surfaces of the gasket are parallel to each other, and the gasket is made of a soft material.

Thereby, the present invention includes the main body, the hand wheel, and the gasket. The main body has the side wall opening for directly fitting on the bathtub spout. The bottom of the main body is directly connected to the outlet of the bathtub spout. The conical recess of the hand wheel screwedly connected to the main body abuts against the pull rod head to drive the pull rod head to move up and down. The installation is convenient and quick. The main body can be connected with bathtub spouts of different specifications, having a better suitability for the existing bathtub spouts with a pull rod on the market. Compared with the existing products on the market, the present invention is convenient for installation and has a better suitability.

DETAILED DESCRIPTION OF THE PREFERRED EMBODIMENTS

Embodiments of the present invention will now be described, by way of example only, with reference to the accompanying drawings.

Figure 1:
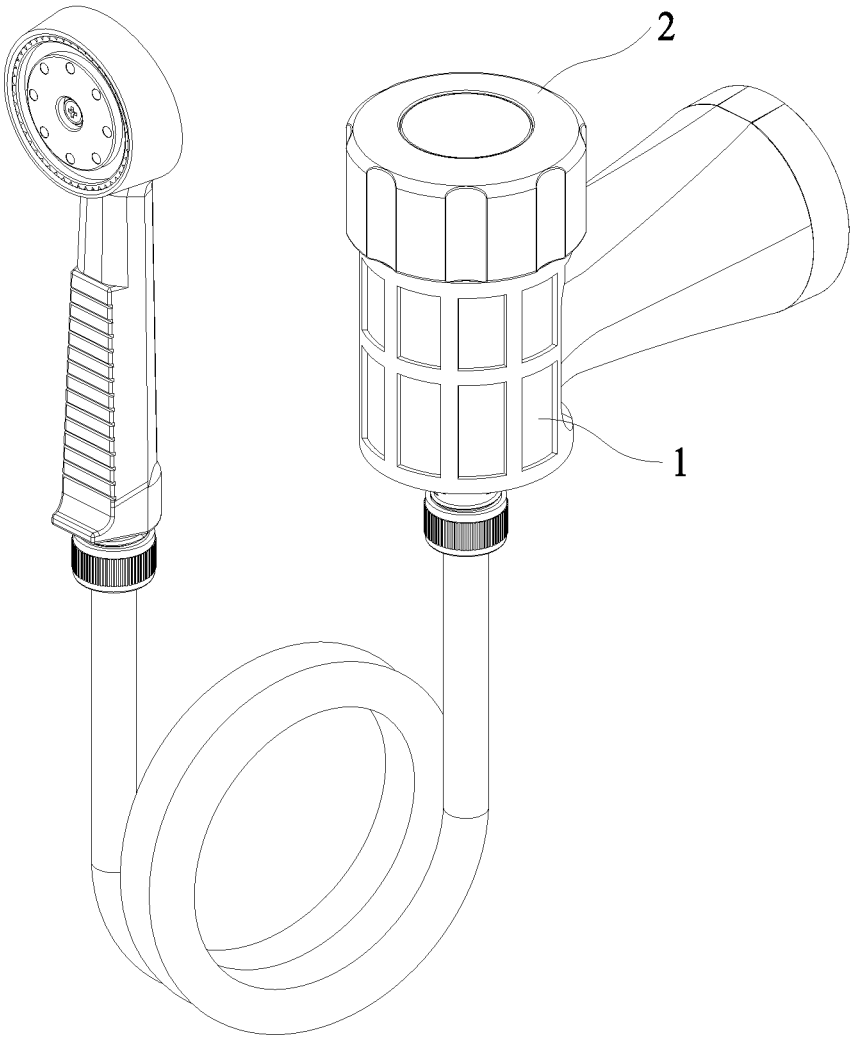
FIG. 1 is a perspective view of the present invention.
Figure 1A:
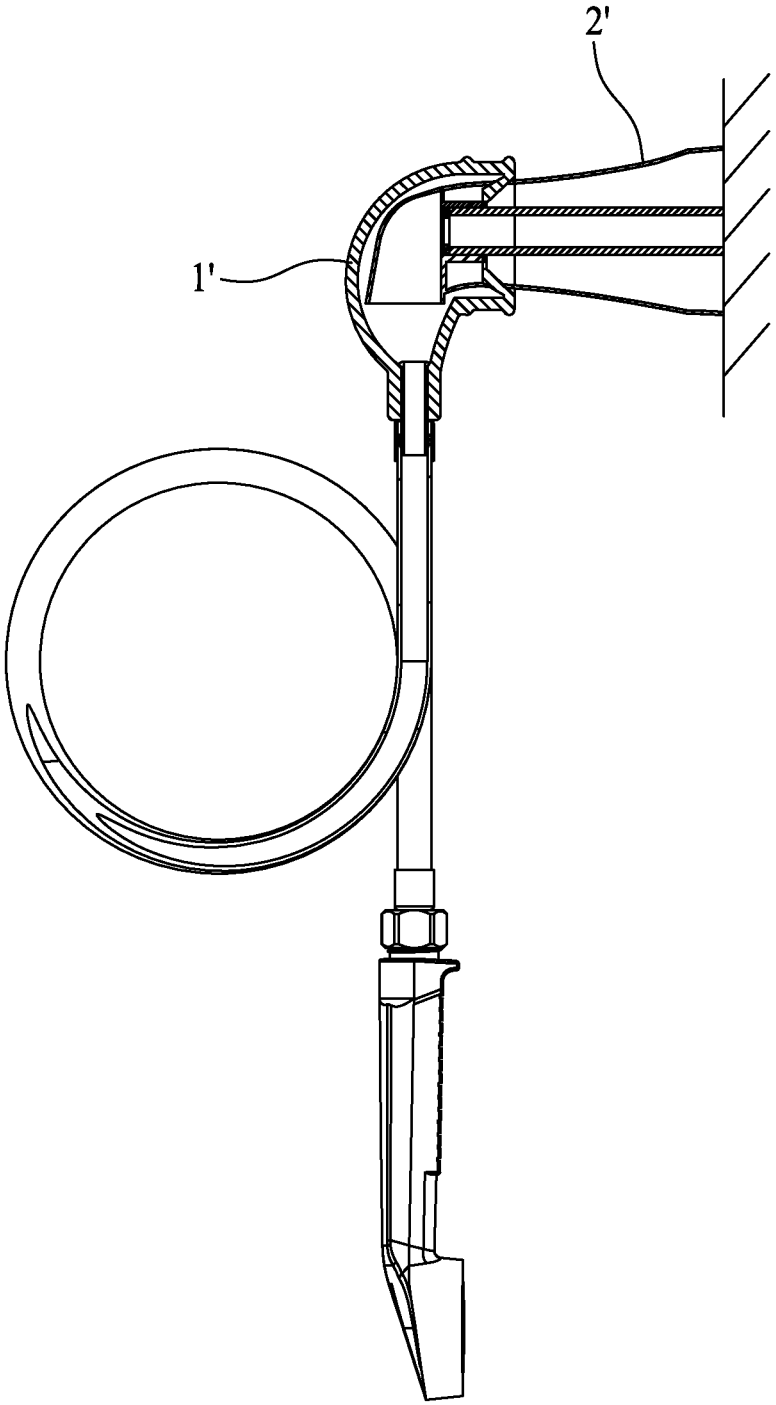
FIG. 1A is a schematic view showing the connection of a conventional shower head and a bathtub spout.
Figure 2:
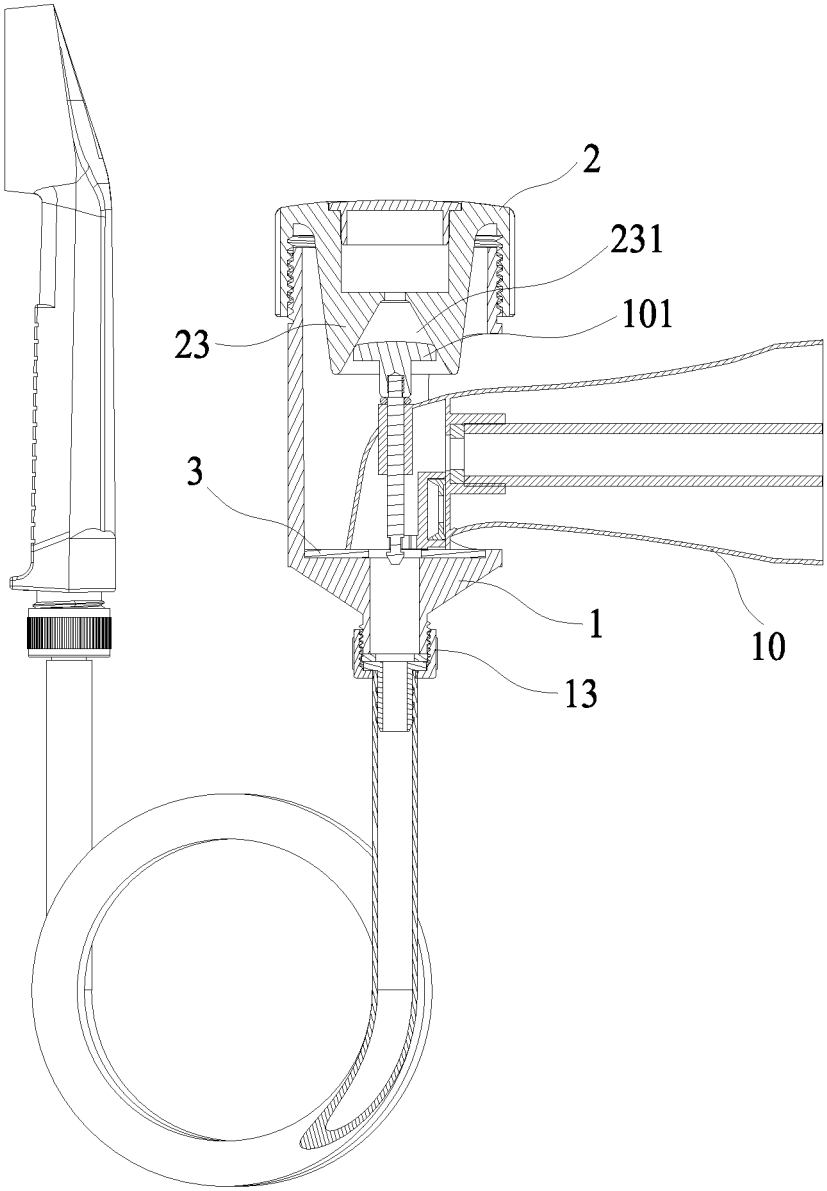
FIG. 2 is a sectional view of the present invention.
Figure 3:
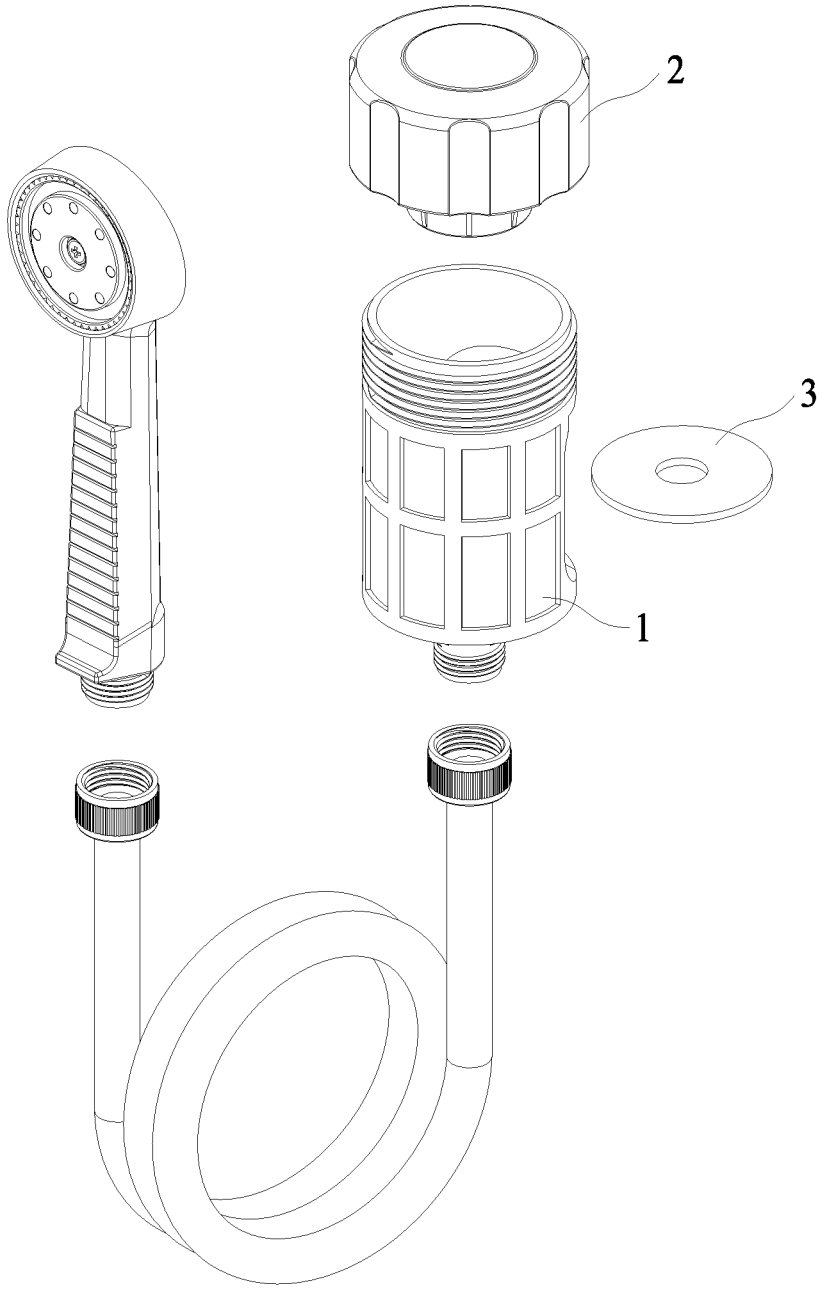
FIG. 3 is an exploded view of the present invention.

As shown in FIGS. 1 to 3, the present invention discloses a bathtub spout quick connecting mechanism which comprises a main body 1, a hand wheel 2, and a gasket 3.

Figure 4:
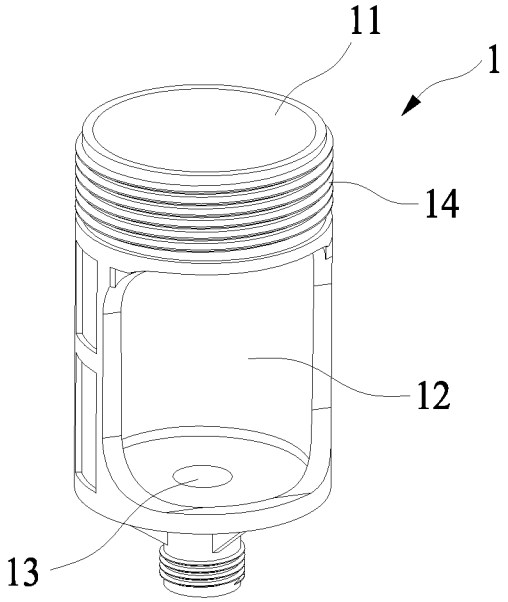
FIG. 4 is a perspective view of the main body of the present invention.
Figure 5:
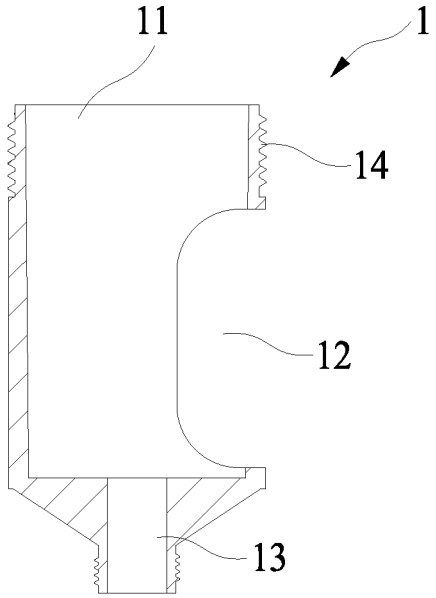
FIG. 5 is a sectional view of the main body of the present invention.

As shown in FIGS. 4 and 5, the main body 1 is a cylindrical member having an open top 11, a side wall opening 12, a through hole 13 at a bottom thereof. An upper outer wall of the main body 1 is formed with male threads 14.

Figure 6:
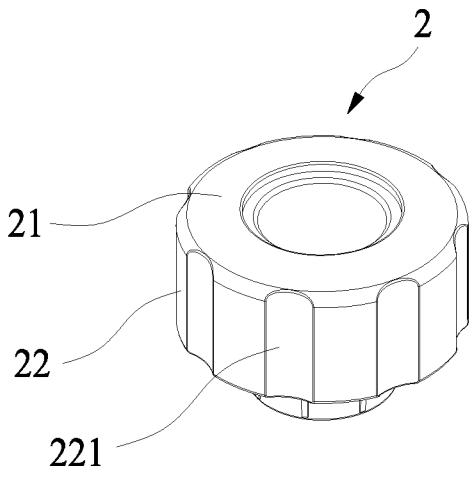
FIG. 6 is a perspective view of the hand wheel of the present invention.
Figure 7:
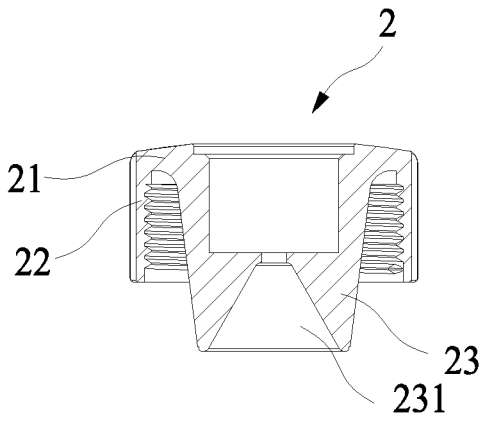
FIG. 7 is a sectional view of the hand wheel of the present invention.

As shown in FIGS. 6, 7 and 2, the top of the hand wheel 2 is a disc 21. An outer edge of the disc 21 extends downward to form an annular grip 22. An outer wall of the annular grip 22 is formed with an arris 221. An inner wall of the annular grip 22 is formed with female threads. The bottom of the disc 21 is provided with a boss 23 extending in the direction perpendicular to the disc 21. A free end of the boss 23 is formed with a conical recess 231 therein. The female threads of the annular grip 22 of the hand wheel 2 screwing with the male threads 14 on the upper outer wall of the main body 1. The boss 23 of the hand wheel 2 is inserted through the open top 11 of the main body 1, and the conical recess 231 at the free end of the boss 23 is fitted on a pull rod head 101 of a bathtub spout 10.

Figure 8:
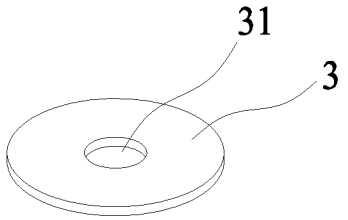
FIG. 8 is a perspective view of the gasket of the present invention.
Figure 9:
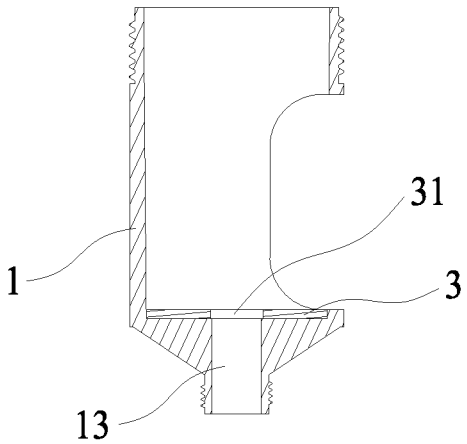
FIG. 9 is a sectional view of the main body and the gasket of the present invention.

As shown in FIGS. 8 and 9, the gasket 3 has a central perforation 31, and the upper and lower surfaces of the gasket 3 are parallel to each other. The gasket 3 is made of a soft material, such as rubber or silicone. The gasket 3 is attached to the inner bottom surface of the main body 1, and the central perforation 31 of the gasket 3 is in communication with the through hole 13 at the bottom of the main body 1.

The working principle of the present invention is described hereinafter.

Figure 10:
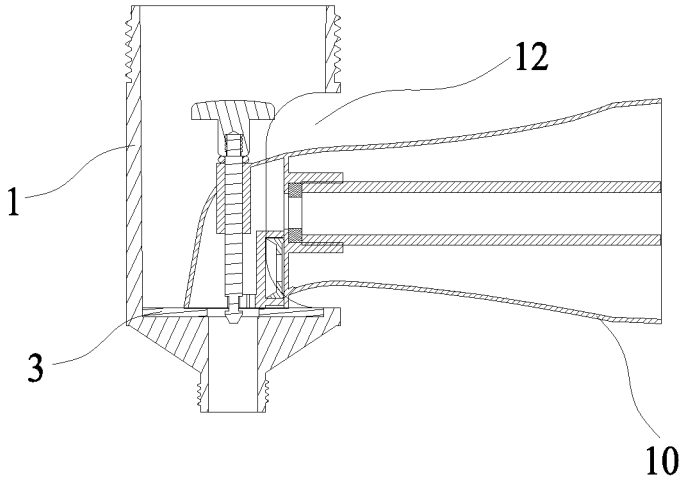
FIG. 10 is a sectional view of the main body of the present invention mounted to the bathtub spout.
Figure 11:
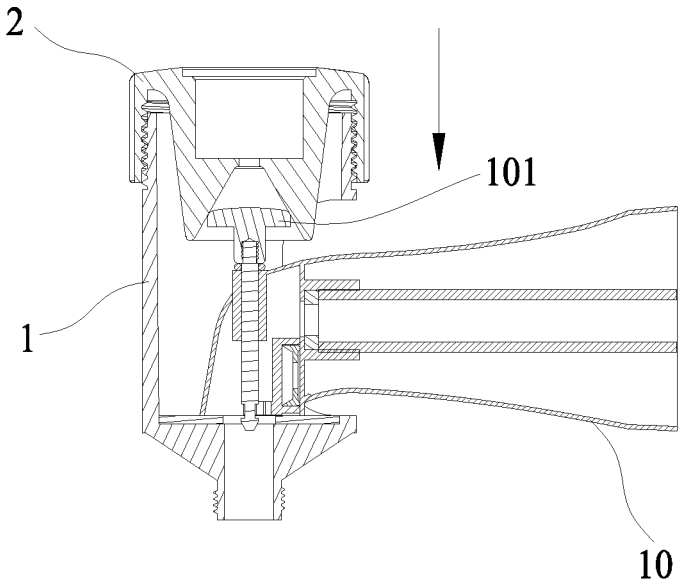
FIG. 11 is a sectional view of the present invention mounted to the bathtub spout.

As shown in FIGS. 2, 10 and 11, when in use, the hand wheel 2 is rotated clockwise, the conical recess 231 of the boss 23 of the hand wheel 2 is moved downward to contact with the pull rod head 101 and to move the pull rod head 101 toward the center, so that the outlet of the bathtub spout 10 is kept unobstructed relative to the through hole 13 at the bottom of the main body 1. The water flows from the tail end of the bathtub spout 10 through the gasket 3 into the through hole 13 at the bottom of the main body 1, and then flows into the hose, and finally sprays out from the shower head.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A bathtub spout connecting mechanism, comprising a main body, a hand wheel, and a gasket; the main body being a cylindrical member having an open top, a side wall opening, a through hole at a bottom thereof, an upper portion of an outer wall of the cylindrical member of the main body being formed with male threads; a top of the hand wheel being a disc, an outer edge of the disc extending downward to form an annular grip, an inner wall of the annular grip being formed with female threads, a bottom of the disc being provided with a boss extending in a direction perpendicular to the disc, a free end of the boss being formed with a conical recess therein, the female threads of the annular grip of the hand wheel screwing with the male threads on the upper outer wall of the main body, the boss of the hand wheel being inserted through the open top of the main body, the conical recess at the free end of the boss being fitted on a pull rod head of a bathtub spout; the gasket being attached to an inner bottom surface of the main body, the gasket having a central perforation communicating with the through hole at the bottom of the main body;

wherein the cylindrical member of the main body has a cylindrical circumferential wall having an inside surface that defines a cylindrical space, the cylindrical space having an inside diameter; and the open top of the cylindrical member is defined by the inside surface of the cylindrical member such that a diameter of the open top is identical to the inside diameter of the cylindrical space of the cylindrical member;

wherein the boss of the hand wheel is received through the open top of the main body into the cylindrical space such that a circumferential surface of the boss faces the inside surface of the cylindrical member of the main body; the annular grip of the hand wheel defines an open space having a cross-sectional dimension that is larger in size than an outside diameter of the outer wall of the cylindrical member, such that the upper portion of the outer wall of the cylindrical member is received in the open space defined by the annular grip, wherein the annular grip and the boss of the hand wheel define therebetween an annular space into which the upper portion of the cylindrical member of the main body is received; and wherein the conical recess formed in the free end of the boss has an inclined internal surface that defines a truncated conic configuration tapering toward the free end of the boss such that the conical recess has a predetermined inside diameter at the free end that is greater, in size, than the pull rod head and is reduced in an inward direction, wherein the inclined surface forces the pull rod head toward a center of the conical recess as the annular grip is screwed onto the upper portion of the cylindrical member of the main body through mating engagement between the female threads of the annular grip and the male threads of the main body.

2. The bathtub spout connecting mechanism as claimed in claim 1, wherein an outer wall of the annular grip is formed with an arris.

3. The bathtub spout connecting mechanism as claimed in claim 1, wherein upper and lower surfaces of the gasket are parallel to each other, and the gasket is made of a resilient material.

* * * * *